United States Patent [19]

Shaw

[11] Patent Number: 4,821,779

[45] Date of Patent: Apr. 18, 1989

[54] METHOD AND APPARATUS FOR RELEASING DEFECTIVELY INSERTED WEFT THREADS IN WEAVING MACHINES

[75] Inventor: Henry Shaw, Vleteren, Belgium

[73] Assignee: Picanol N.V., Belgium

[21] Appl. No.: 113,077

[22] Filed: Oct. 27, 1987

[30] Foreign Application Priority Data

Nov. 7, 1986 [NL] Netherlands ..... 8602827

[51] Int. Cl.[4] ..... D03D 49/00

[52] U.S. Cl. ..... 139/116; 139/429

[58] Field of Search ..... 139/1, 116, 429, 435, 139/450, 452

[56] References Cited

U.S. PATENT DOCUMENTS

| | | | |
|---|---|---|---|
| 3,805,850 | 4/1974 | Van Duynhoven | 139/1 |
| 4,502,512 | 3/1985 | Suzuki | 139/116 |
| 4,503,889 | 3/1985 | Van Mullekom | 139/1 |
| 4,529,010 | 7/1985 | Aarts | 139/1 |
| 4,635,686 | 1/1987 | Terasaki | 139/116 |
| 4,664,157 | 5/1987 | Shin | 139/116 |

FOREIGN PATENT DOCUMENTS

| | | |
|---|---|---|
| 8202215 | 6/1982 | Netherlands . |
| 8204665 | 12/1982 | Netherlands . |
| 1430520 | 9/1974 | United Kingdom . |

*Primary Examiner*—Henry S. Jaudon

*Attorney, Agent, or Firm*—Bacon & Thomas

[57] ABSTRACT

A method and device for releasing defectively inserted weft threads in weaving machines by reversing the machine to expose the defectively inserted thread in the open shed, initially releasing the weft thread from the ends of the fell by moving the weft thread away from the fell at its ends, positioning releasing elements between the released portion of the weft thread and the fabric fell, releasing an additional portion of the weft thread from the fell by moving the releasing elements away from the fabric fell toward the machine reed, positioning an additional releasing element between the seft thread and the fabric fell, releasing an additional portion of weft thread from the fell by moving the additional releasing element away from the fell and toward the reed, and containing the positioning of the releasing elements across the shed of the weaving machine until the weft thread is released over the entire length of the shed.

14 Claims, 7 Drawing Sheets

METHOD AND APPARATUS FOR RELEASING DEFECTIVELY INSERTED WEFT THREADS IN WEAVING MACHINES

This invention relates to a method for releasing defectively inserted or mispicked weft threads in weaving machines, in other words, a method for freeing a beaten-up defectively inserted weft thread in the shed in a manner such that it can readily be removed from the shed. The invention furthermore relates also to devices which use said method.

BACKGROUND OF THE INVENTION

A weaving machine is disclosed in Dutch patent publication No. 82 04665 which contains means for removing defectively inserted weft threads from the shed. The means disclosed in this case provide for an element which can be moved back and forth through the length of the shed and is introduced into the shed from the weft insertion side of the weaving machine. The element is passed between the cloth line and the weft thread to be released from the fell. However, this device has the disadvantage that the element is moved back and forth in the weft direction over the warp threads and consequently can catch on the wrap threads and damage them. Another disadvantage of this device is that it is only suitable for releasing sectins of weft thread which are located at the weft insertion side of the machine. In the case of a broken weft thread, the other section of broken thread is not released. Yet another disadvantage of this device is that it requires alot of space at the weft insertion side of the shed and this entails difficulties in positioning the other necessary components of the loom.

A similar device for releasing defectively inserted weft threads is also disclosed in the Dutch patent publication No. 82 02215. In this case, the defectively inserted weft thread is released at a number of points in the shed and then drawn through the uppermost warp threads. The actual release of the faulty weft thread is carried out by allowing a hook-shaped element to slide over the cloth until it reaches the vicinity of the cloth line, the beaten-up defectively inserted weft thread, which has already been beaten-up but not yet fixed in position, is released and taken to the center of the shed by the hook-shaped element. This device does not, however, offer complete reliability in consisently releasing the defectively inserted weft thread since, if the defectively inserted weft thread is securely clamped between the warp threads, the hook-shaped element will slide over the defectively inserted weft thread and fail in releasing the weft thread from the fell.

A shuttleless weaving machine is disclosed in the British patent publication No. 1,430,520 in which a defectively inserted weft thread, more particularly a broken weft thread, is removed from the shed from either side of the shed by means of devices installed on both sides of the shed.

SUMMARY OF THE INVENTION

The present invention relates to a method for releasing defectively inserted weft threads from the fabric fell, and also to a device which uses said method, which eliminates the above mentioned disadvantages.

According to this invention, the method for releasing defectively inserted weft threads has the characteristic that is essentially consists in:

eliminating the binding between the defectively inserted weft thread and the warp threads;

initially releasing or holding the defectively inserted weft thread free from the fabric edge or fell by moving one or both of the thread ends away from the fabric fell and holding it apart from the fell;

positioning one releasing element or more releasing elements between the fabric fell and the released weft thread end or the released thread ends;

releasing the weft thread end or the thread ends from a further portion of the fabric fell by moving the releasing element or releasing elements away from the fabric fell in a direction toward the reed;

respositioning a releasing element between the weft thread section or weft thread sections thus released, and the fabric fell;

in turn releasing over a further distance along the fabric fell the defectively inserted weft thread by moving the last mentioned releasing element away from the fabric fell in a direction toward the reed;

and continuing the last named two steps stepwise across the shed until the weft thread is released over the desired length.

BRIEF DESCRIPTION OF THE DRAWINGS

With the intention of demonstrating the features of the present invention more satisfactorily, the subject method and a number of embodiments of the present invention are described below as examples only and without any limiting intent with reference to the accompanying drawings in which.

DESCRIPTION OF THE PREFERRED EMBODIMENTS

Figure 1:
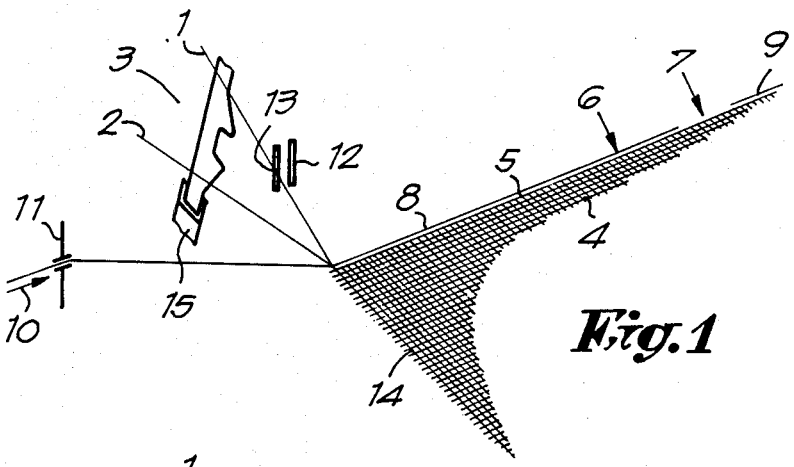
FIGS. 1–5 inclusive show diagrammatically in stepped sequence the method of inserting and moving a first and second releasing element into and through the shed according to one embodiment of the invention.

The diagrammatic depictions in FIGS. 1–5 inclusive show one of the uppermost warp threads 1, one of the lowermost warp threads 2, the area of the shed 3 formed by all the warp threads, the fabric 4 and the fabric fell 5. For simplicity, only a small portion of the loom structure such as the one tooth of the reed 15, only a corner portion of the cloth 4, and only the two end warp threads 1, 2 of the shed 3 are shown. Furthermore, a defectively inserted weft thread 6 is shown which is the result of, for example, a weft thread break 7 into two weft thread sections 8 and 9. The weft thread 6 is still connected to the weft thread feed supplied in the direction 10, for example via a conventional thread eye or a thread clamp 11. According to the method of this embodiment, use is furthermore made of two movable needle or pin-type releasing elements 12 and 13 of the subject defectively inserted weft thread releasing device. During the normal weaving process, said releasing elements 12 and 13 of the releasing device are located outside of the shed 3 and in a position adjacent to the fabric edge 14 or the edge of the shed 3.

Figure 2:
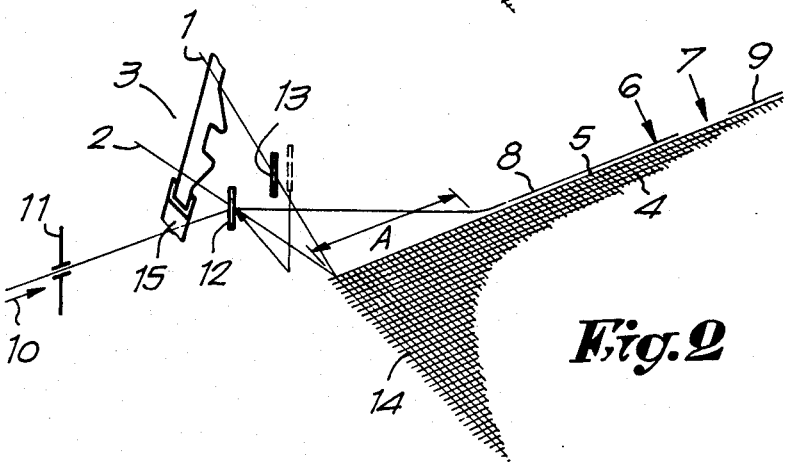

If a thread break 7 is now detected, which can be done automatically by any known defectively inserted weft thread detection devices, the weaving machine is stopped and the sequential steps of the method of operation of the invention device are automatically controlled. If the faulty weft thread 6 has already been beat-up into the fabric fell and woven into the fabric by the crossing of the warp threads 1 and 2 to form a new shed, the new shed should first be eliminated by automatically controlling the machine on detection of the broken thread to run the weaving machine backwards to form the old shed containing the broken weft thread and to expose the broken weft thread in the old shed as shown in FIG. 1. According to the method of the invention, a releasing element 12 is then lowered outside but adjacent to the shed between the defectively inserted weft thread and the fabric fell, and is moved away from the fabric fell 5 in a direction toward the reed 15 of the loom (FIG. 2). This forces the defectively inserted weft thread 6 free of the fell 5, and it is released over a distance A from the fell of the fabric between the upper and lower warp threads 1,2.

Figure 3:
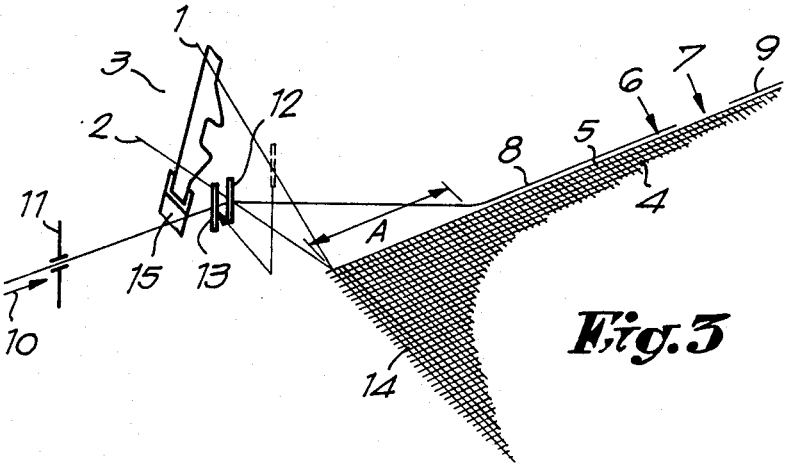
Figure 4:
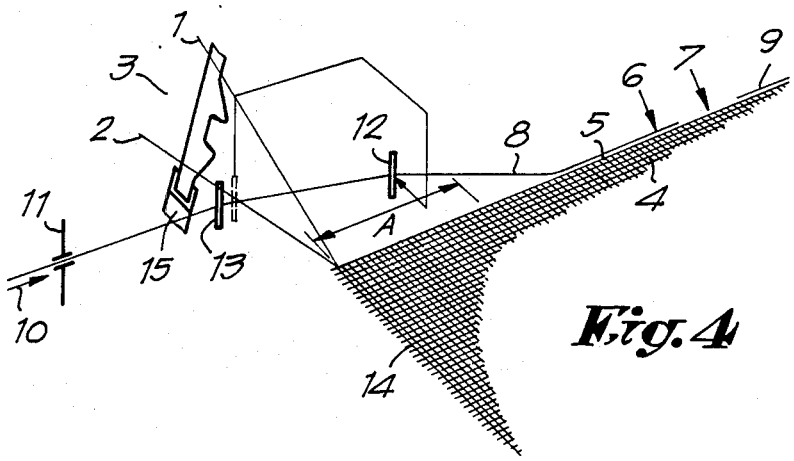
Figure 5:
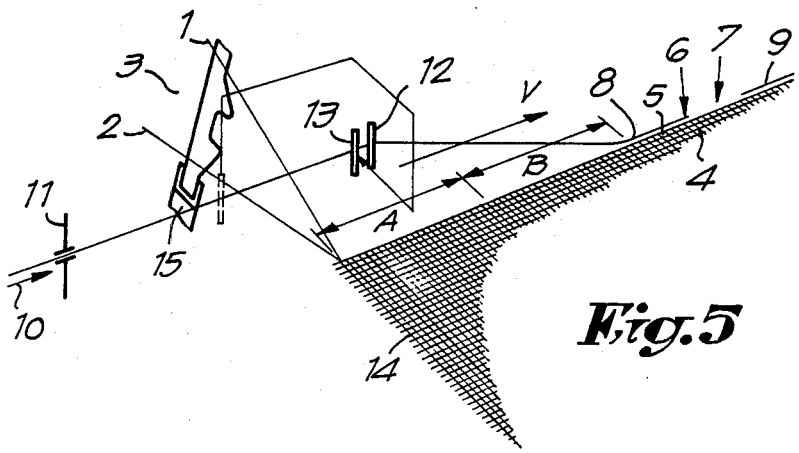

After this initial segment of the defectively inserted weft thread is released, the second releasing element 13 is placed next to the first releasing element as shown in FIG. 3. According to the method of the invention and as shown in FIG. 4, the first releasing element 12 is then moved upwards above the upper warp threads 1 of the shed, then it is moved across the warp threads 1 a predetermined distance less than the distance A, then it is moved back in the direction of the cloth 4 and the fabric fell 5, and then it is lowered through the warp threads 1 into the shed at a position between the defectively inserted weft thread and the fabric fell 5. By now again moving the first releasing element 12 away from the fabric fell 5 and into the shed 3 toward the reed 15, the defectively inserted weft thread 6, more particularly the thread section 8 of the weft thread, is released over a further distance B (FIG. 5). The second releasing element 13 is then again moved to a position beside the first releasing element 12 to ensure that the weft thread 6 always remains taut, otherwise the latter could not be released by the releasing element 12.

Figure 6:
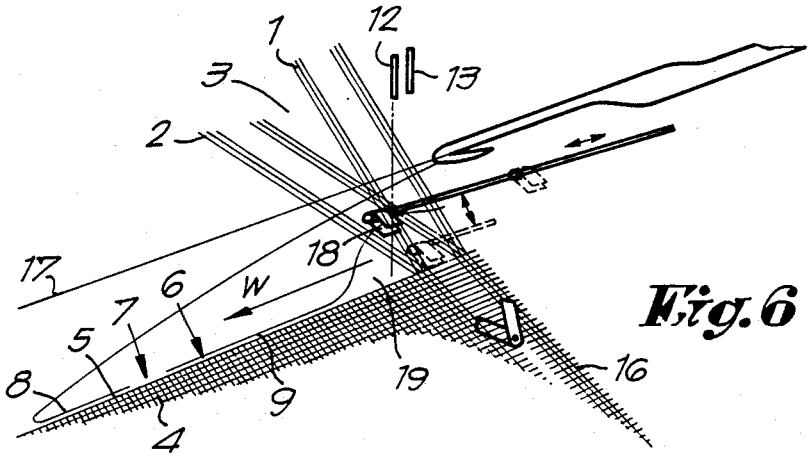
FIG. 6 shows a weft thread clamping device according to one embodiment of the invention.
Figure 7:
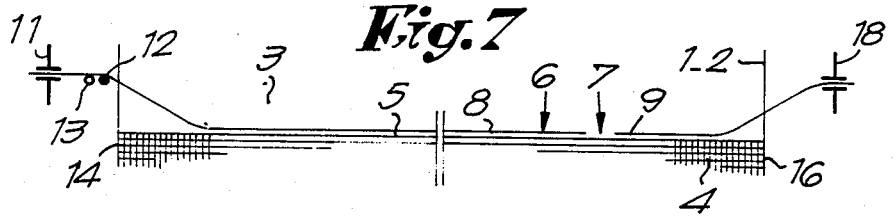
FIGS. 7–13 inclusive show diagrammatically in stepped sequence the method according to the first embodiment of the invention in which both thread sections of a broken weft thread are to be removed.
Figure 8:
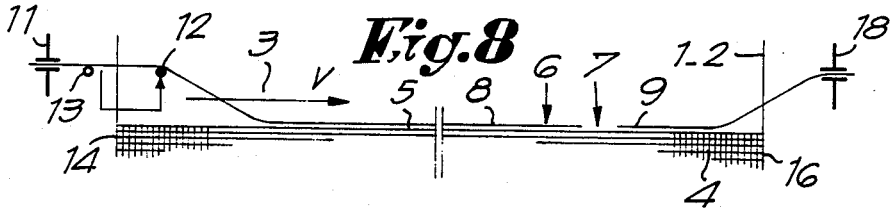
Figure 9:
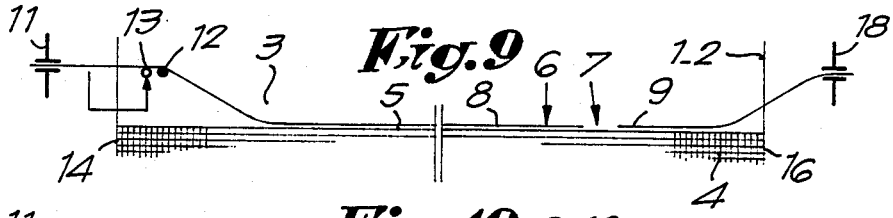
Figure 10:
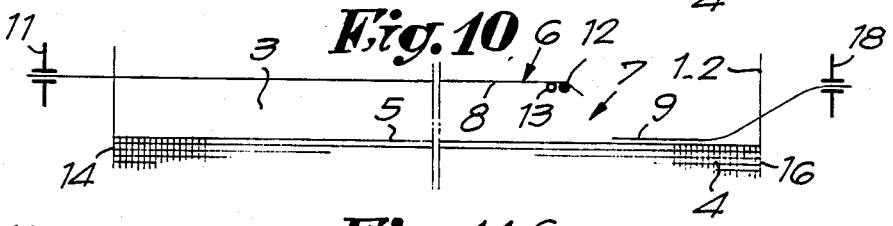
Figure 11:
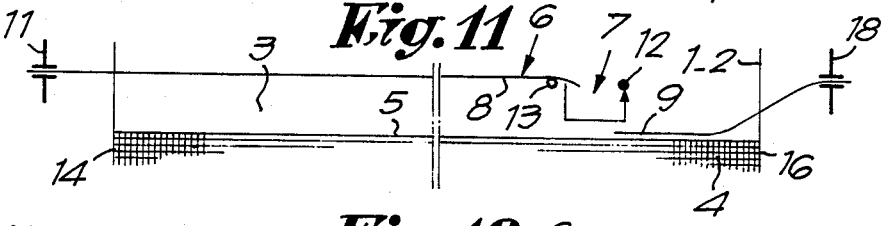
Figure 12:
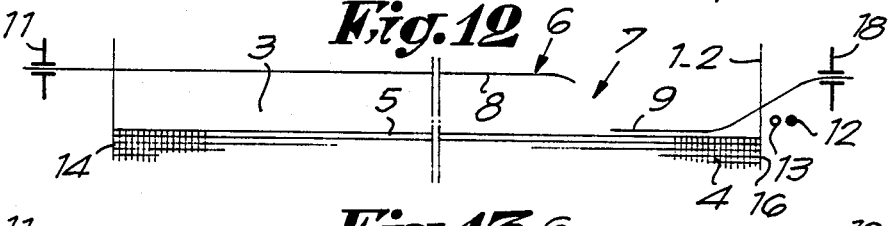

As shown in FIG. 5, the releasing element 13 is moved through a path similar to that of element 12 to again place it next to the first releasing element 12 in a preprogrammed series of sequential steps. By repeating the above mentioned cycle of the first and second releasing elements across the entire length of the shed, a complete operation is built up in which, in a stepwise advancing movement indicated as V in FIG. 5, the defectively inserted weft thread 6, or at least the weft thread section 8, is released from the fabric fell. Following the completion of the sequence of steps, the released weft thread section 8 can then easily be removed from the shed by any thread removal means known in the art on resumption of the normal weaving operation. For example, the weft thread section 8 may be removed from the shed at the opposite fabric edge 16, as shown in FIG. 6, by inserting a new weft thread 17 by a rapier which draws off the released weft section 8 in the form of a loop. Since the releasing element 12 and 13 are always repositioned between an already previously released section of the defectively inserted weft thread 6 and the fabric fell 5, the thread to be released is gripped in a positive manner by the releasing elements, this being in contrast to the device of the above mentioned Dutch patent publication No. 82 02215 in which the releasing elements have to be forced between the fabric fell and the defectively inserted weft thread.

It is clear from the described method that the operation to free a defectively inserted weft thread 6 may start not only from the one fabric edge 14 as described above, but it may also start from the opposite fabric edge 16 (FIG. 6). In other words, the method of the invention also includes executing an additional operation by means of releasing elements 12 and 13 following a direction of movement indicated by W in FIG. 6, In order to free the second weft thread section 9 of the broken weft thread. Since the free end of the weft thread 6 is completely woven into the fabric near the fabric edge 16, it should first be pulled free from the fabric fell by means of any movable clamping means 18 known in the art, for example a mechanical clamp or a suction nozzle. In this manner a free space 19 is created between the broken thread section 9 and the fabric fell 5 for the initial positioning of the releasing elements 12 and 13 in the same manner as that described for the fabric edge 14 and with reference to FIGS. 1–3. The release of the weft thread section 9 then takes place in an analogous manner as described with reference to FIGS. 1–5 inclusive.

It is clear that, in the event of a thread break 7, if it is desired to release one of the weft thread sections 8 or 9 completely from the fell of the fabric, the releasing elements 12 and 13 should be moved through their sequential steps in the respective direction indicated by V and W in FIGS. 5 and 6 over the complete weaving widths of the shed, this being so because it is not known where the thread break is situated in the shed.

Figure 13:
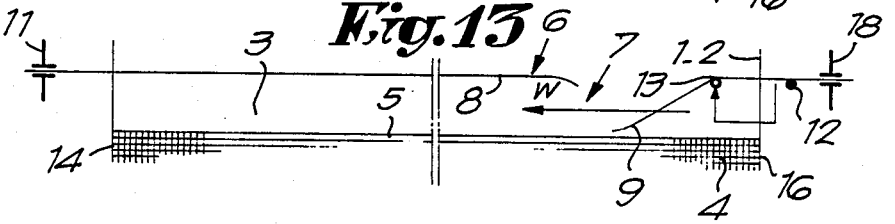

It is desired to release both thread sections 8 and 9 of a broken weft thread 6 according to the above described method of the invention, the releasing elements must be moved through the sequence of steps shown in FIGS. 7–13 inclusive. According to the schematic diagrams of FIGS. 7–12 inclusive, in the method of the invention a first operation is executed from the left end of the shed 3, to the right end of the shed. As specifically shown in FIG. 11, the releasing elements 12 and 13 cannot finish up their series of sequential steps across the shed between the second thread section 9 and the fabric fell 5 in this process, with the result that the second thread section 9 is not released by the left to right movement of the element 12, 13. Therefore, in order to release the second thread section 9 from the fabric fell 5, a second operation of sequential steps of the elements is provided in which the releasing elements 12 and 13 execute their series of sequential steps across the shed 3 from right to left, the start of which is shown in FIG. 13.

According to an alternate embodiment not shown in the figures, it is also possible to employ two separate devices which simultaneously release the thread sections 8 and 9 respectively from the oppositely situated fabric edges 14 and 16, the devices executing a crossing movement.

Figure 14:
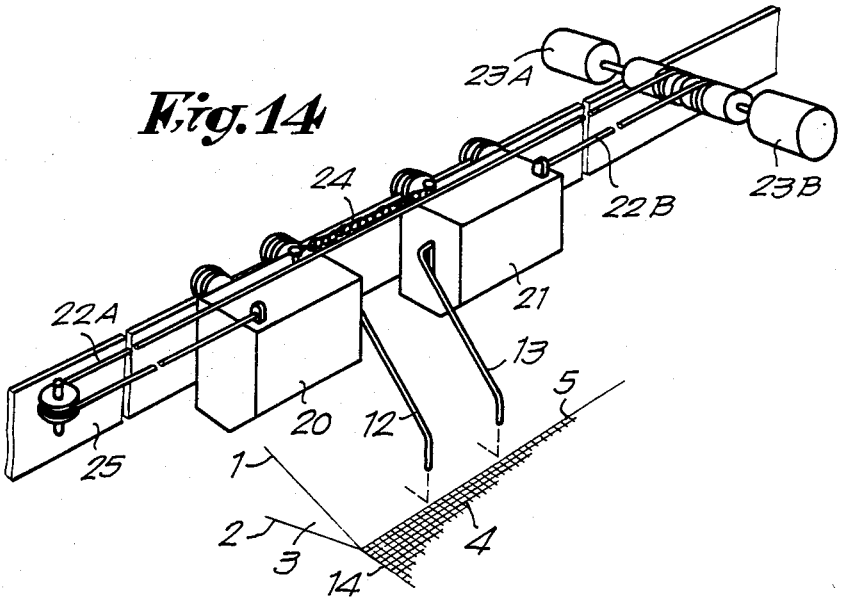
FIG. 14 shows a device for performing the method of the invention according to FIGS. 7–13.

FIG. 14 shows an embodiment of the device according to the invention for releasing the faulty weft threads according to the above described method. The above mentioned releasing elements 12 and 13 are in this case embodied in needle form and are respectively mounted for movement on two small carriages or the like, 20 and 21 which are mounted for movement along a guide 25 mounted stationary relative to the loom above the shed 3. Drive means which are not shown in the figures are provided in the small carriages 20 and 21 in order to automatically move the releasing elements 12 and 13 between the warp threads 1 and 2 and between the defectively inserted weft thread and the fabric fell 5, and to move the releasing elements 12, 13 into and out of the shed, toward and away from the reed respectively, in order to release the weft thread from the fabric fell 5.

The carriages 20 and 21 form the means of automatically moving the releasing elements 12 and 13 from left to right and then from right to left across the length of the shed along the guide to provide the sequential stepwise movement of the method described above. The carriages 20 and 21 are provided with a drive formed by cable connections 22A and 22B with the stepping motors 23A and 23B respectively to move the carriages to predetermined positions along the fell. The carriage 21 is connected to the carriage 20 by means of an eleastic means 24, such as, for example, a tension spring. Furthermore, each of the carriages 20 and 21 contain an automatic braking or locking mechanism that permits the carriage to be locked in a predetermined position with respect to the guide 25 and the length of the shed 3 during the sequential stepwise movement of the carriages along the guide according to the method described above, the method of operation being automatically controlled by a control means (not shown).

Figure 15:
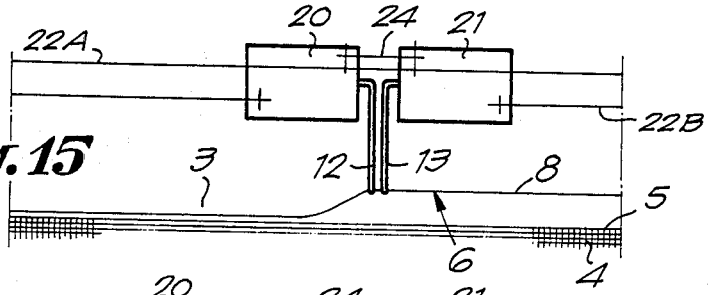
FIGS. 15–17 inclusive illustrate the operation of the device according to FIG. 14 in the stepped sequence of the method of the invention.
Figure 16:
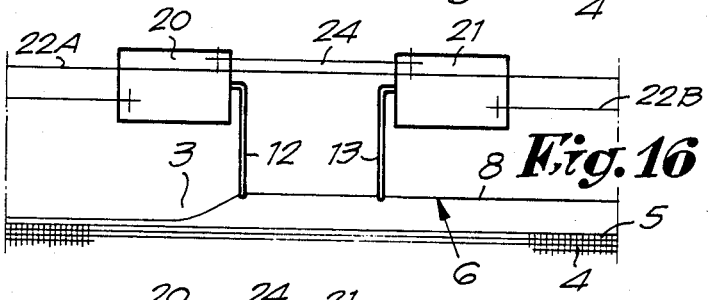
Figure 17:
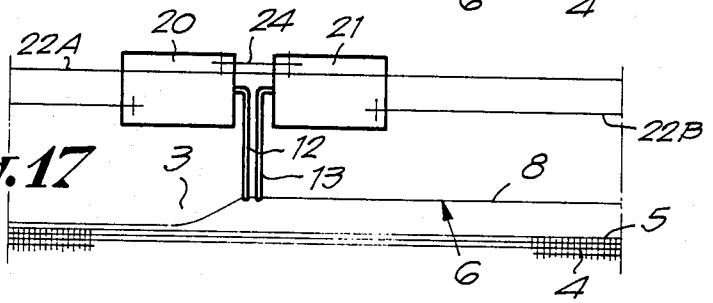

The operation of the device according to the invention shown in FIG. 14 is shown diagrammatically in sequential steps in FIGS. 15–17 inclusive for the above described movement direction W of the method of the invention, and is controlled automatically on detection of a broken weft thread in any conventional manner. In FIG. 15, the carriages are positioned adjacent each other at the start of a series of sequential steps of the releasing elements 12, 13. In a first step the releasing element 12 is moved out of the shed 3 and the carriage 20 is advanced along the guide 25 (not shown), while the carriage 21 remains locked to the guide. The spring 24 is stretched between the carriages 20, 21. In the situation in FIG. 16, the releasing element 12 is then set in operation according to the method described above to release an additional portion of the weft thread 8 from the fabric fell 5. The needle 13 is then removed from the shed 3 and the locking mechanism of the carriage 21 is released. The tension spring 24 pulls the second carriage 21 back adjacent to the first carriage 20. The releasing element 13 is then lowered again, as shown in FIG. 17. The preceding steps can then be executed repeatedly to release the entire length of the weft thread 8 from the fabric fell 5.

For the movement of the carriages 20, 21 in the driection V described in the method of the invention above, the functions of the carriages 20 and 21 are reversed.

The necessary control means for controlling the movement of the carriages 20, 21 and the releasing elements 12, 13 according to the above described method of operation are also provided. The control means automatically performs the above described operations on detection of a defectively inserted or broken weft thread. Preferably, the control of the carriages 20, 21 takes place via the cable connections 22A and/or 22E which are constructed as electrical conductors such as insulated wires, along which control signals can be transmitted to the carraiges to control the movements of the releasing element drive means.

Figure 18:
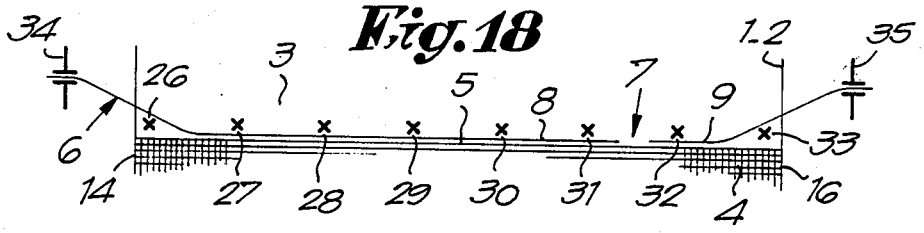
FIGS 18–31 show diagrammatically an additional embodiment of the device of the present invention and, in stepped sequence, the method of operation of the embodiment of the device.
Figure 19:
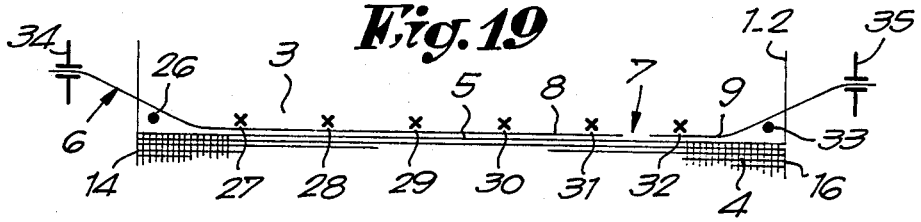
Figure 20:
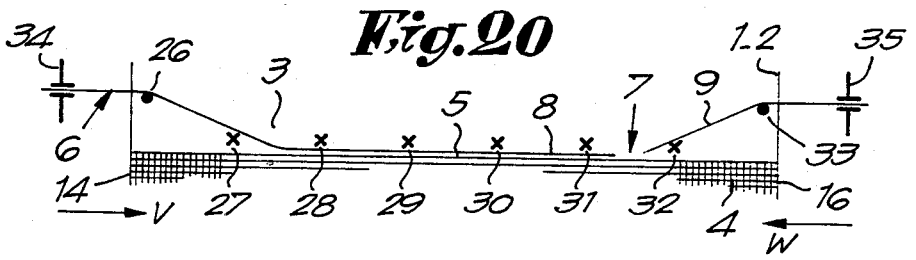
Figure 21:
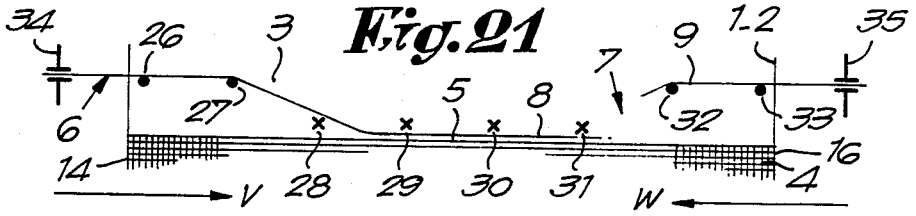

The device for releasing the faulty weft thread 6 does not necessarily have to be movable along the length of the fabric fell. FIG. 18 shows diagrammatically an alternative embodiment of the invention in which use is made of a series of releasing elements represented by the small crosses numbered 26–33. The releasing elements are distributed over the complete weaving width of the loom in the vicinity of the fabric fell 5 and are situated in stationary positions indicated by the small crosses either above or below the shed. A possible method of operation of this embodiment is shown stepwise in FIGS. 18–31 inclusive. Here the releasing elements 26–33 inclusive are represented by means of small crosses if they are situated in their retracted position outside the shed 3, and by means of dots if they have been moved to their advanced position in the shed. The weft thread 6 is, of course, first released initially near the fabric edges 14 and 16 by any known means, for example by means of clamps 34 and 35 or suction nozzles as described above with reference to FIG. 6. As shown in FIG. 19, release elements, 26 and 33 respectively, are then lowered between adjacent warp threads and between the defectively inserted weft thread 6 and the fabric fell 5 at both ends of the shed 3, and they finish the weft releasing movement between the fabric fell 5 and the respective weft thread sections 8 and 9 in such the same manner as the previously described releasing elements 12, 13 of the movable carriages 20, 21.

The previously described method of the invention is then stepwise executed from both ends by the sequential weft releasing movements of each of the releasing elements 26 to 33 in order in the direction across the shed indicated by V, and in the direction across the shed indicated by W in the FIGS. 20–31.

The two series of releasing operations, performed in the movement directions V and W respectively, should be executed over the entire width of the shed, which is clearly shown in the FIGS. 20–31. In particular, it can be seen in FIG. 23 that, if the two series of operations were to stop in the middle of the shed 3, in other words at the point where they meet each other, then it is possible that the thread section 8 would not be completely released from the fabric fell by the releasing movement of the releasing elements 30 and 31.

The releasing elements of this alternative embodiment are also provided with the necessary drive and control means to execute the above mentioned steps of the method of operation performed by the releasing elements of the movable carriage embodiment.

Figure 32:
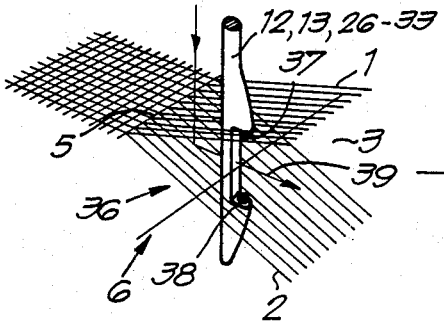
FIG. 32 shows in detail one of the releasing elements according to the present invention.

Preferably, the above mentioned releasing elements of both embodiments of the invention device 12, 13 and 26–33 inclusive are provided with thread detectors 36. In FIG. 32 these consist, for example, of two conventional optical detection elements 37 and 38 situated opposite each other at a distal end of the releasing element. According to another embodiment, however, mechanical detectors or the like can also be used. The detection elements 37 and 38 are placed on the releasing element in such a manner that they can detect the releasing elements engagement with the weft thread during the forward movement (indicated by 39 in FIG. 32) of the releasing element.

Figure 22:
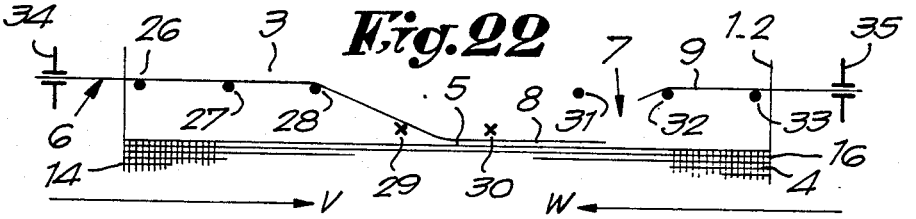
Figure 23:
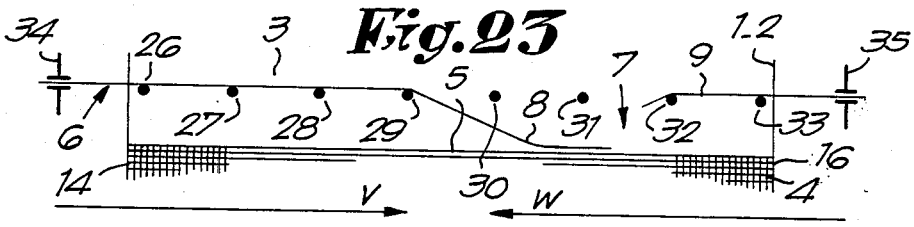
Figure 24:
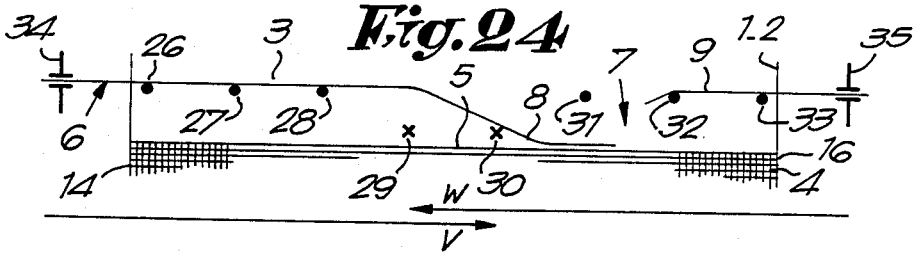
Figure 25:
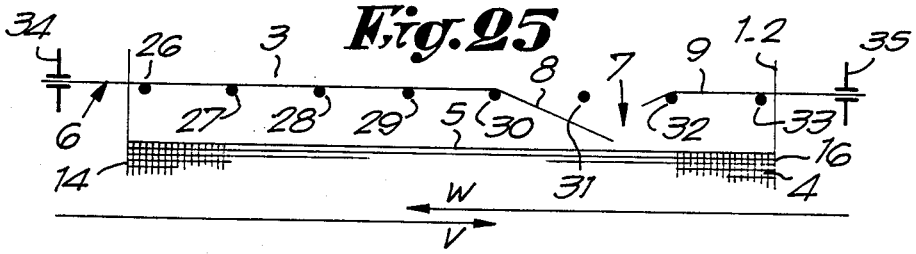
Figure 26:
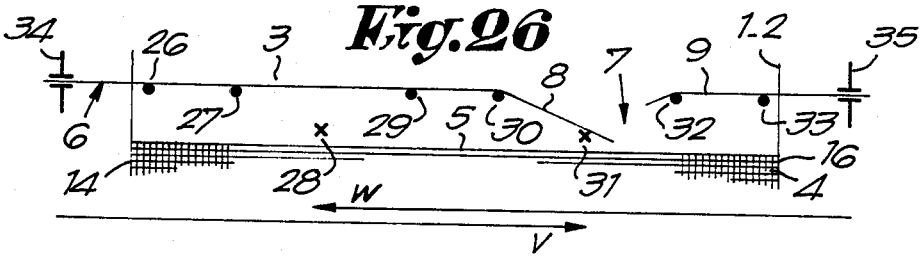
Figure 27:
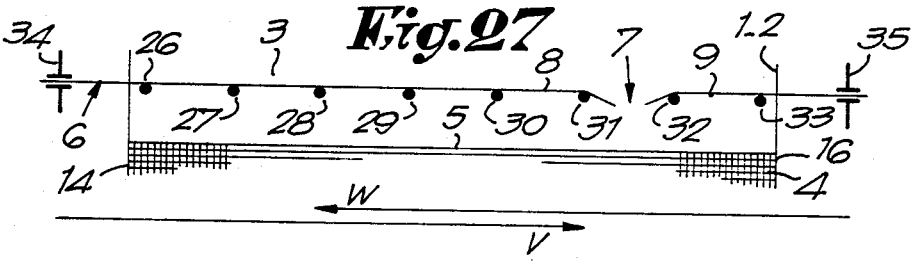
Figure 28:
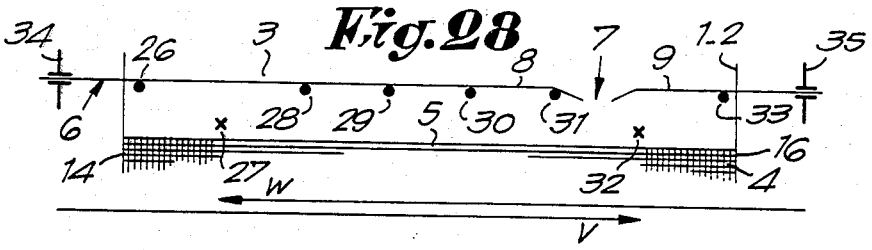
Figure 29:
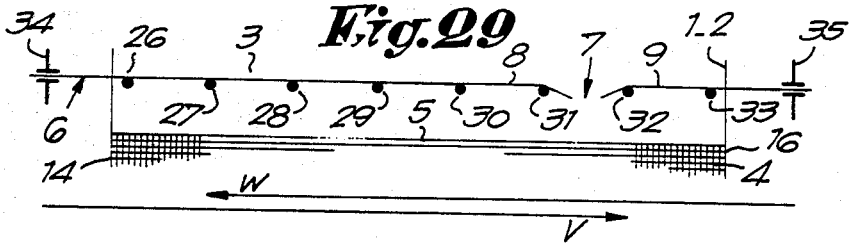
Figure 30:
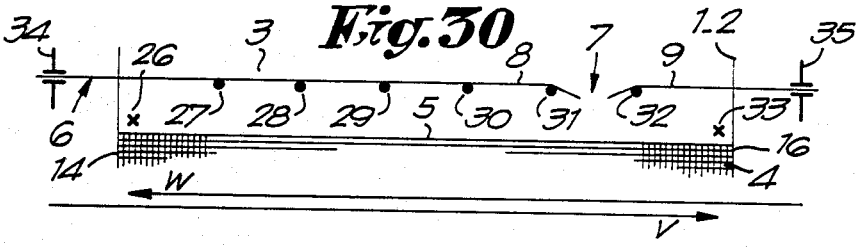
Figure 31:
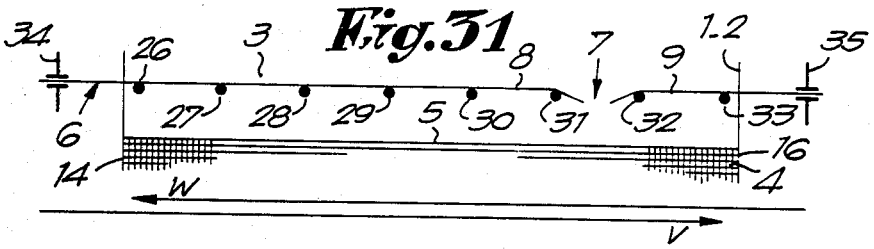

The use of the thread detectors 36 offers the advantage that the above mentioned releasing elements do not always have to operate over the complete width of the machine, but only over the distance in which the weft thread section concerned is present as detected by the weft thread detectors in the releasing elements. With reference to the embodiment of FIGS. 18–31 inclusive, this means that the stepwise operation of the device across the shed in the direction W is interrupted when the situation in FIG. 22 is reached since weft thread is no longer detected by the thread detectors of the releasing element 31, while the stepwise operation of the device in the direction V is continued until the situation in FIG. 27 is reached where the weft thread is no longer detected by the detectors of the releasing element 31.

By means of the thread detectors 36, it is also possible to detect whether all the thread has been removed from the shed 3.

Figure 33:
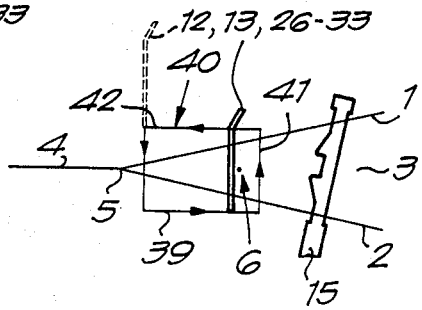
FIG. 33 shows diagrammatically the path in which the releasing elements of the invention are moved.

The releasing elements 12 and 13, or respectively 26–33 inclusive, move through a path in a plane that is parallel to the warp threads of the loom and preferably a rectangular path 40 as shown in FIG. 33. The path described a first downward movement of the releasing element between the defectively inserted weft thread 6 and the fabric fell 5, an advancing movement 39 releasing the weft thread 6 from the fell 5, an upward movement 41 that prevents the released weft thread from being carried back to the fell 5, for example, because it has been caught on the releasing element, and a return movement 42 to its original position.

The present invention is by no means intended to be limited to the embodiments described above as examples, but the subject method and device for releasing weft threads can be realized in accordance with variations of all kinds without departing from the scope of the invention.

I claim:

1. A method of removing a defectively inserted weft thread from a beat-up position in a fabric fell of a weaving loom which has been automatically stopped on detection of the defectively inserted weft thread and reversed through its operative cycle until the shed into which the weft thread is defectively inserted is reformed, the method including:

inserting a releasing element between the weft thread and the fabric fell at a predetermined position along the fell of the fabric;

moving the releasing element away from the fabric fell toward the area of the shed, thereby releasing a portion of the weft thread from the fabric fell;

moving the releasing element out of the area of the shed after the portin of the weft thread has been released from the fabric fell; and performing the inserting and moving operations of the releasing element in a step-wise manner at a plurality of predetermined positions across the entire length of the fell, thereby removing the defectively inserted weft thread from its beat-up position in the fabric fell.

2. A method according to claim 1 including performing the inserting and moving operations in a step-wise manner at the plurality of predetermined positions across the length of the fell in a first sequence from a first end of the fabric fell to a second end of the fabric fell, and then in a second sequence from the second end of the fabric fell to the first end of the fabric fell.

3. A method according to claim 1 including performing the inserting and moving operations in a step-wise manner at the plurality of predetermined positions across the length of the fabric fell in a first sequence from a first end of the fabric fell to a second end of the fabric fell, and in a second sequence simultaneous with the first sequence from the second end of the fabric fell to the first end of the fabric fell.

4. A method according to claim 2 including:

detecting the presence of the weft thread at each predetermined position along the fell of the fabric during the moving operation of the releasing element away from the fell in both the first and second sequences; and stopping the respective sequence at the predetermined position where no weft thread is detected.

5. A method according to claim 3 including:

detecting the presence of the weft thread at each predetermined position along the fell of the fabric during the moving operation of the releasing element away from the fell in both the first and second sequences; and stopping the respective sequence at the predetermined position where no weft thread is detected.

6. An apparatus for removing a defectively inserted weft thread from a beat-up position in a fabric fell of a weaving loom which has been automatically stopped on detection of the defectively inserted weft thread and reversed through its operative cycle until the shed into which the weft thread is defectively inserted is reformed, the apparatus comprising:

a releasing element normally positioned outside the shed;

a drive means operatively coupled to the releasing element and arranged to drive the releasing element from its normal position through a step-wise path between the defective weft thread and the fabric fell, into the area of the shed thereby removing the defective weft thread from the fell, and out of the area of the shed back to its normal position;

a moving means operatively coupled to the drive means and arranged to move the drive means and the operatively coupled releasing element in a step-wise manner across the width of the fabric along the fabric fell;

and a control means operatively coupled to the drive means and the moving means to control the moving means to move the drive means across the width of the fabric, stopping the drive means at predetermined positions along the fabric fell, and to control the drive means to drive the releasing element from its normal position through its step-wise path when the drive means is stopped at each of the predetermined positions.

7. An apparatus as claimed in claim 6 comprising:

a second releasing element normally positioned outside the shed;

a second drive means operatively coupled to the second releasing element and arranged to drive the second element from its normal position through a step-wise path between the defective weft thread and the fabric fell, into the area of the shed thereby removing the defective weft thread from the fell, and out of the area of the shed back to its normal position;

the moving means being operatively coupled to the second drive means and arranged to move the second drive means and the operatively coupled second releasing element in a step-wise manner across the width of the fabric along the fabric fell;

and the control means being operatively coupled to the second drive means and the moving means, said control means arranged to control the moving means to move the second drive means across the width of the fabric, to stop the second drive means at predetermined positions along the fabric fell, and to control the second drive means to drive the second releasing element from its normal position through its step-wise path when the second drive means is stopped at each of the predetermined positions.

8. An apparatus as claimed in claim 7 wherein:

the moving means comprises a guide rail fixed relative to the loom and parallel to the fabric fell;

a first carriage mounted for sliding movement on the guide rail and supporting the first drive means;

a second carriage mounted for sliding movement on the guide rail and supporting the second drive means; and an elastic means connecting the first and second carriage.

9. An apparatus as claimed in claim 8 wherein the moving means further comprises first and second motor means operatively connected to the first and second carriages by first and second cable connections respectively, the first and second motor means being arranged to move the first and second drive means and carriages in a step-wise manner along the guide rail and across the width of the fabric.

10. An apparatus as claimed in claim 9 wherein the moving means further comprises first and second brake means mounted on the first and second carriages respectively, and arranged to brake the first and second carriages relative to the guide rail at the predetermined positions along the fabric fell.

11. An apparatus as claimed in claim 9 wherein the control means is operatively connected to the first and second drive means by the first and second cable connections respectively, and the first and second cable connections are arranged to transmit control signals from the control means to the first and second drive means respectively.

12. An apparatus as claimed in claim 6 wherein the releasing element is provided with a weft thread detector arranged to detect the presence of a weft thread adjacent the element when the releasing element is driven into the area of the shed.

13. An apparatus for removing a defectively inserted weft thread from a beat-up position in a fabric fell of a weaving loom which has been automatically stopped on detection of the defectively inserted weft thread and reversed through its operative cycle until the shed into which the weft thread is defectively inserted is reformed, the apparatus comprising:

a plurality of releasing elements normally positioned outside the shed at predetermined positions along the fabric fell across the width of the fabric;

a plurality of drive means, each operatively connected to a releasing element and arranged to drive the releasing element from its normal position through a step-wise path between the defectively inserted weft thread and the fabric fell, into the area of the shed thereby removing the defective weft thread from the fell, and out of the area of the shed back to its normal position;

and control means operatively coupled to the plurality of drive means to control each drive means in sequence, starting from at least one end of the fabric fell, to drive the operatively connected releasing element from its normal position through its step-wise path.

14. An apparatus as claimed in claim 13 wherein the releasing elements are provided with weft thread detectors arranged to detect the presence of a weft thread adjacent the elements when the releasing elements are driven into the area of the shed.

* * * * *